US009872519B2

(12) United States Patent
Xiang

(10) Patent No.: US 9,872,519 B2
(45) Date of Patent: Jan. 23, 2018

(54) BATTERY POLE, ELECTRONIC CIGARETTE USING THE BATTERY POLE, AND METHOD FOR IDENTIFYING AN ATOMIZER OF THE ELECTRONIC CIGARETTE

(71) Applicant: Zhiyong Xiang, Guangdong (CN)

(72) Inventor: Zhiyong Xiang, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 525 days.

(21) Appl. No.: 14/099,304

(22) Filed: Dec. 6, 2013

(65) Prior Publication Data

US 2015/0075545 A1 Mar. 19, 2015

(30) Foreign Application Priority Data

Sep. 13, 2013 (CN) ..... 2013 1 0420416

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS 5,060,671 A * 10/1991 Counts ..... A24F 47/008 128/202.21
5,698,987 A * 12/1997 Hayashi ..... G01R 27/02 324/678
8,604,436 B1 * 12/2013 Patel ..... H03K 17/941 250/338.1
2010/0163063 A1 * 7/2010 Fernando ..... A24F 47/008 131/184.1
2013/0104916 A1 * 5/2013 Bellinger ..... A61M 11/041 131/328
2014/0096782 A1 * 4/2014 Ampolini ..... A24F 47/008 131/328
2014/0270727 A1 * 9/2014 Ampolini ..... F24H 9/0005 392/387

* cited by examiner

*Primary Examiner* — Eric Yaary
(74) *Attorney, Agent, or Firm* — Tim Tingkang Xia, Esq.; Locke Lord LLP

(57) ABSTRACT

An electronic cigarette comprising a battery pole and an atomizer is provided, the battery pole includes a battery and a control module, and the atomizer includes an identification signal generation module and an atomizing module; the identification signal generation module is configured for sending an identification signal to the control module by wired transmission or wireless transmission; the control module is configured for determining whether the atomizer matches with the battery pole basing on whether the identification signal is received or whether the identification signal is correct, and controlling the battery to be electrically connected with or to be electrically isolated from the atomizing module according to the determining result. The case that different kinds of tobacco juices with different tastes may be mixed together, and the case that battery poles and atomizers provided by different manufacturers may be randomly assembled together can be avoided.

3 Claims, 7 Drawing Sheets

BATTERY POLE, ELECTRONIC CIGARETTE USING THE BATTERY POLE, AND METHOD FOR IDENTIFYING AN ATOMIZER OF THE ELECTRONIC CIGARETTE

CROSS-REFERENCE TO RELATED APPLICATIONS

This non-provisional application claims priority under 35 U.S.C. §119(a) on Patent Application No. 201310420416.4, filed in P.R. China on Sep. 13, 2013, the entire contents of which are hereby incorporated by reference.

FIELD OF THE INVENTION

The present application relates to the field of daily electrical products, and more particularly relates to a battery pole, an electronic cigarette using the battery pole, and a method for identifying an atomizer of the electronic cigarette.

BACKGROUND OF THE INVENTION

An electronic cigarette generally comprises a battery pole and an atomizer. In most electronic cigarettes, the battery poles are electrically connected to the atomizers by threads, so that an atomizer and a battery pole of an electronic cigarette can be replaced by atomizers and battery poles of other electronic cigarettes. Therefore, a battery pole of an electronic cigarette in the prior art has no function of identifying an atomizer of the electronic cigarettes.

However, the compatibility between the atomizers and the battery poles may cause confusion and mistakes of product functions. For example, if rated power of an atomizer is different from rated power of a battery pole connected with the atomizer, smoke generated by the atomizer may have a peculiar smell, or the amount of the smoke may be very small. If a resistance of a heating wire of an atomizer is different from a resistance of a battery pole connected with the atomizer, the atomizer may start over-current protection and do not generate any smoke. Additionally, since any one of the conventional battery poles can be connected with any one of the conventional atomizers to form an electronic cigarette to use, different kinds of tobacco juices with different tastes may be mixed together, and battery poles and atomizers provided by different manufacturers may be randomly assembled together. Thus, users may have poor experience and the users' awareness about the factory and brand of electronic cigarettes is hindered, which is inconvenient to quit smoking.

Therefore, the prior art has defects and needs to be improved.

SUMMARY OF THE INVENTION

The objective of the present application is to provide a battery pole, an electronic cigarette using the battery pole, and a method for identifying an atomizer of the electronic cigarette, aiming at defect in the prior art that the atomizers and the battery poles can be randomly assembled together, the atomizers are unable to be identified, and confusion and mistakes of product functions are caused.

The technical solutions of the present application for solving the technical problems are as follows:

in one aspect, an electronic cigarette comprising a battery pole and an atomizer is provided; the battery pole includes a battery and a control module electrically connected to the battery, and the atomizer includes an identification signal generation module and an atomizing module;

the identification signal generation module is configured for sending an identification signal to the control module by wired transmission or wireless transmission;

the control module is configured for determining whether the atomizer matches with the battery pole basing on whether the identification signal is received or whether the identification signal is correct, and controlling the battery to be electrically connected with or to be electrically isolated from the atomizing module according to the determining result, so that the electronic cigarette is controlled to work normally or controlled to stop working.

In one embodiment, the battery pole further includes a first interface, and the atomizer further includes a second interface;

the first interface is connected to the battery and the control module respectively, and the second interface is connected to the first interface, the atomizing module, and the identification signal generation module respectively;

the first interface and the second interface are configured for connecting with each other to achieve an electrical connection between the battery and the atomizing module.

In another embodiment, the identification signal generation module is configured for sending the identification signal to the control module by the wireless transmission;

the control module includes a microprocessor unit, a switch unit, and an identification signal identifying unit;

the microprocessor unit is connected to the battery, the switch unit, and the identification signal identifying unit respectively; and the switch unit is further connected to the first interface;

the microprocessor unit is configured for sending a detecting signal to the identification signal generation module in a preset time;

the identification signal generation module is configured for sending the identification signal when receiving the detecting signal; the identification signal identifying unit is configured for receiving the identification signal from the identification signal generation module by the wireless transmission and identifying the identification signal;

the microprocessor unit is further configured for controlling the switch unit to be turned on and off according to an identifying result generated by the identification signal identifying unit, and then controlling the battery to be electrically connected with or to be electrically isolated from the first interface.

In another embodiment, the wireless transmission includes at least one of optical transmission and radio frequency transmission.

In another embodiment, the wireless transmission is the optical transmission, the identification signal is an optical signal, the identification signal generation module is a light-emitting element, and the identification signal identifying unit is a photosensitive element.

In another embodiment, the identification signal generation module includes a first LED, and the identification signal identifying unit includes a phototransistor;

an anode of the first LED is connected to an anode of the second interface, and a cathode of the first LED is connected to a cathode of the second interface;

an emitter of the phototransistor is connected to a cathode of the first interface, and a collector of the phototransistor is connected to an anode of the first interface and the microprocessor unit respectively;

a base of the phototransistor is configured for sensing optical signal sent from the first LED, and then driving the collector of the phototransistor to send a current signal corresponding to the optical signal to the microprocessor unit.

In another embodiment, the switch unit includes an MOSFET; a grid of the MOSFET is connected to the microprocessor unit, a source of the MOSFET is grounded, and a drain of the MOSFET is connected to the cathode of the first interface; and the grid of the MOSFET is configured for receiving a control signal sent from the microprocessor unit and controlling the MOSFET to be turned on and off according to the control signal.

In another embodiment, the identification signal generation module is configured for sending the identification signal to the control module by the wired transmission;

the control module includes a microprocessor unit and a switch unit;

the microprocessor unit is connected to the battery, the switch unit, and the identification signal generation module respectively, and the switch unit is further connected to the first interface;

the microprocessor unit is configured for receiving the identification signal from the identification signal generation module by the wired transmission and identifying the identification signal; and the microprocessor unit is further configured for controlling the switch unit to be turned on and off according to an identifying result determined by the microprocessor unit, and then controlling the battery to be electrically connected with or to be electrically isolated from the first interface.

In another embodiment, the identification signal is a level signal or a voltage value; and the identification signal generation module includes a pull-up resistor and a pull-down resistor or includes a divider resistor.

In another embodiment, the battery pole further includes a warning module, and the warning module is connected to the control module; the warning module is configured for sending a warning under the control of the control module when the control module determines that the atomizer doesn't match with the battery pole.

In another embodiment, the battery pole further includes a smoking trigger unit, and the smoking trigger unit is connected to the control module; the smoking trigger unit is configured for sending a smoking trigger signal to the control module when sensing air flow;

the control module is configured for determining whether the atomizer matches with the battery pole according to the identification signal after receiving the smoking trigger signal.

In another aspect, a battery pole configured for being connected with an atomizer to form an electronic cigarette is provided; the battery pole includes a battery and a control module electrically connected to the battery;

the control module is configured for determining whether the atomizer matches with the battery pole basing on whether an identification signal of the atomizer is received or whether the identification signal is correct, and controlling the battery to be electrically connected with or to be electrically isolated from the atomizer according to the determining result, so that the electronic cigarette is controlled to work normally or controlled to stop working.

In another aspect, an atomizer identifying method configured for using the battery pole of the electronic cigarette to identify the atomizer of the electronic cigarette is provided; the atomizer identifying method comprises:

step 1: using the identification signal generation module to send an identification signal to the control module via wired transmission or wireless transmission;

step 2: using the control module to determine whether the atomizer matches with the battery pole basing on whether the identification signal is received or whether the identification signal is correct;

step 3: using the control module to control the battery to be electrically connected with or to be electrically isolated from the atomizing module according to the determining result obtained by the step 2.

In one embodiment, the atomizer identifying method further comprises:

step 0: before the step 1, electrically connecting a first interface of the battery pole with a second interface of the atomizer.

In another embodiment, the atomizer identifying method further comprises:

step 01: between the step 0 and the step 1, using the control module to supply a detecting signal to the identification signal generation module in a preset time.

In another embodiment, the step 3 further includes: using the control module to control a warning module to send a warning according to the determining result obtained by the step 2.

In another embodiment, the atomizer identifying method further comprises:

step 10: between the step 0 and the step 01, using the control module to detect a smoking trigger signal generated by a smoking trigger unit.

In another embodiment, the atomizer identifying method further comprises:

after the step 3 is completed, performing the step 10 again to wait next identification.

In another embodiment, the atomizer identifying method further comprises:

step 20: between the step 10 and the step 01, calculating smoking times, and determining whether the smoking times reaches preset times; if the smoking times don't reach the preset times, performing the step 10; and if the smoking times reach the preset times, performing the step 01.

When implementing the battery pole, the electronic cigarette using the battery pole, and the method for identifying the atomizer of the electronic cigarette of the present application, the following advantageous effects can be achieved: the electronic cigarette of present application adds the identification signal generation module into the atomizer, and the identification signal generation module is configured to send the identification signal to the control module of the battery pole by wired transmission or wireless transmission. The control module determines whether the atomizer matches the battery pole basing on whether the identification signal is received or whether the identification signal is correct, and then controls the battery to be electrically connected with or to be electrically isolated from the atomizing module according to the determining result. Thus, the atomizer can be identified by the electronic cigarette of the present application. Only if the atomizer is identified as matching the battery pole, the battery pole supplies electric power to the atomizer. If the atomizer does not match the battery pole, although the battery pole is mechanically connected with the atomizer, the control module in the battery pole controls the power supply circuit between the battery and the atomizing module to be cut off. Thus, the case that the smoke generated by the atomizer may have a peculiar smell or the amount of the smoke may be very small due to the difference between the rated power of the atomizer and the rated power of the battery pole, and the case that the atomizer may start over-current protection and do not generate any smoke due to the difference between the resistance of the heating wire of the atomizer and the resistance of the battery pole, can be avoided. Additionally, the case that any one of the conventional battery poles may be connected with any one of the conventional atomizers to form an electronic cigarette to use, the case that different kinds of tobacco juices with different tastes may be mixed together, and the case that battery poles and atomizers provided by different manufacturers may be randomly assembled together can also be avoided. In this way, the users' experience can be improved and the users' awareness about the factory and brand of electronic cigarettes can be enhanced, which is more convenient to quit smoking.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

To make the technical feature, objective and effect of the present application be understood more clearly, now the specific implementation of the present application is described in detail with reference to the accompanying drawings and embodiments.

The present application provides a battery pole, an electronic cigarette using the battery pole, and a method for identifying an atomizer of the electronic cigarette, aiming at the defect that a battery pole in the prior art can be randomly assembled with different atomizers and cannot identify the suitable atomizer, which causes confusion and mistakes of product functions.

Figure 1:
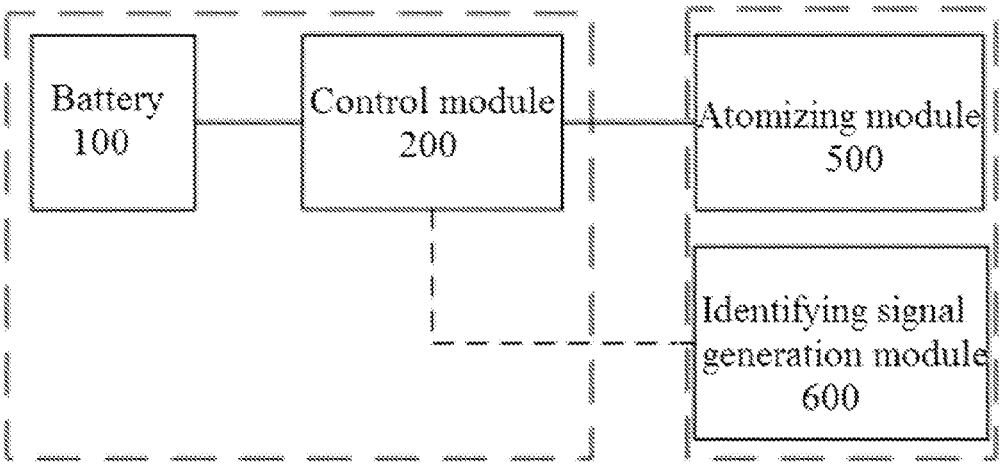
FIG. 1 is a block diagram of an electronic cigarette of the present application.

FIG. 1 is a block diagram of an electronic cigarette of the present application.

The electronic cigarette comprises a battery pole and an atomizer. The battery pole includes a battery 100 and a control module 200 connected to the battery 100; and the atomizer includes an identification signal generation module 600 and an atomizing module 500.

The identification signal generation module 600 is configured for sending an identification signal to the control module 200 by wired transmission or wireless transmission.

The control module 200 is configured for determining whether the atomizer matches with the battery pole basing on whether the identification signal is received or whether the identification signal is correct, and then controlling the battery 100 to be electrically connected with or to be electrically isolated from the atomizing module 500.

Wherein, the identification signal generation module 600 can send the identification signal to the control module 200 actively, and can also passively send the identification signal to the control module 200 upon receiving a detecting signal sent from the control module 200.

If the identification signal generation module 600 is configured to send the identification signal to the control module 200 actively, an internal battery configured for supplying electric power to the identification signal generation module 600 needs to be disposed in the atomizer.

In the case that the identification signal generation module 600 sends out the identification signal passively, as shown in FIGS. 2 to 5, the identification signal generation module 600 in the atomizer sends out the identification signal only after the atomizer is connected to the battery pole.

The electronic cigarette of the present application adds the identification signal generation module 600 into the atomizer. The identification signal generation module 600 is configured for sending an identification signal to the control module 200 of the battery pole by wired or wireless transmission. The control module 200 determines whether the atomizer matches with the battery pole basing on whether the identification signal is received or whether the identification signal is correct, and then controls the battery to be electrically connected with or to be electrically isolated from the atomizing module. In the identification process for the atomizer, only when the atomizer is identified as being correct, the battery pole supplies electric power to the atomizer. If the atomizer does not match the battery pole, although the battery pole is mechanically connected with the atomizer, the control module in the battery pole controls the power supply circuit between the battery and the atomizing module to be cut off, so that the battery does not supply electric power to the atomizing module. Thus, the case that the smoke generated by the atomizer may have a peculiar smell or the amount of the smoke may be very small due to the difference between the rated power of the atomizer and the rated power of the battery pole, and the case that the atomizer may start over-current protection and do not generate any smoke due to the difference between the resistance of the heating wire of the atomizer and the resistance of the battery pole, can be avoided. Additionally, the case that any one of the conventional battery poles may be connected with any one of the conventional atomizers to form an electronic cigarette to use, the case that different kinds of tobacco juices with different tastes may be mixed together, and the case that battery poles and atomizers provided by different manufacturers may be randomly assembled together can also be avoided. In this way, the users' experience can be improved and the users' awareness about the factory and brand of electronic cigarettes can be enhanced, which is more convenient to quit smoking.

Figure 2:
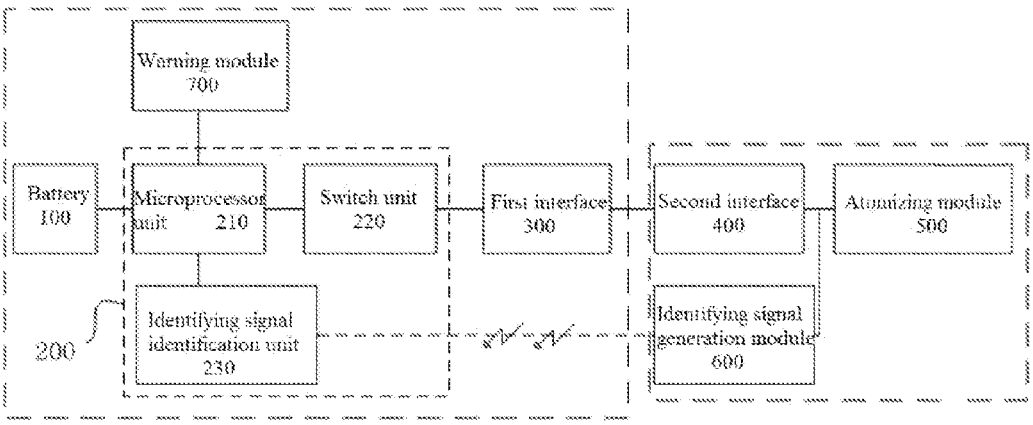
FIG. 2 is a block diagram of an electronic cigarette of a first embodiment of the present application.
Figure 3:
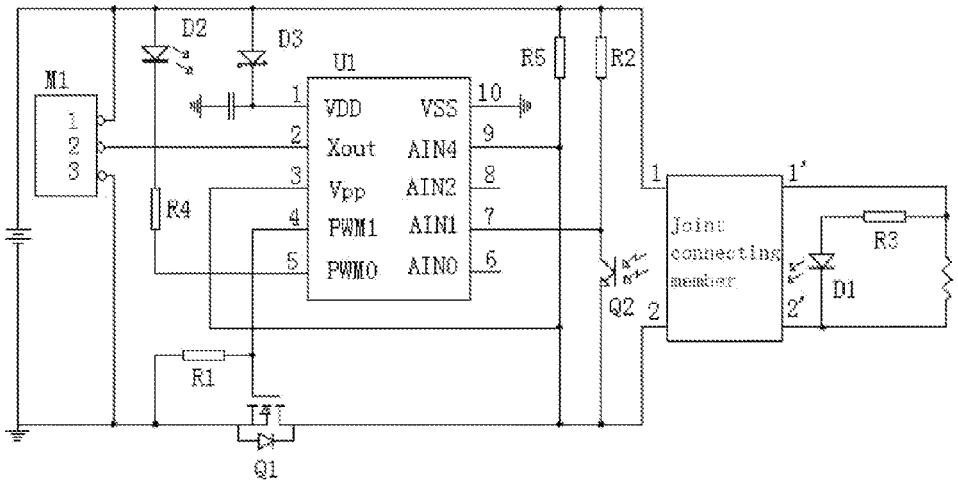
FIG. 3 is a circuit diagram of the electronic cigarette shown in FIG. 2.

FIG. 2 is a block diagram of an electronic cigarette of a first embodiment of the present application; and FIG. 3 is a circuit diagram of the electronic cigarette shown in FIG. 2.

In the first embodiment, the identification signal generation module 600 needs to receive a detecting signal from the control module 200 at first, and then is enabled to send out the identification signal; and the identification signal is sent to the control module 200 by wireless transmission.

Particularly, the battery pole includes a battery 100, a control module 200, a first interface 300, and a warning module 700; and the atomizer includes a second interface 400, an atomizing module 500, and an identification signal generation module 600.

The control module 200 is connected to the battery 100, the first interface 300, and the warning module 700 respectively; and the second interface 400 is connected to the first interface 300, the atomizing module 500 and the identification signal generation module 600 respectively.

The first interface 300 is connected to the second interface 400 to establish an electrical connection between the battery 100 and the atomizing module 500. After the first interface 300 is connected to the second interface 400, the control module 200 sends a detecting signal to the identification signal generation module 600 in a preset time. Upon receiving the detecting signal, the identification signal generation module 600 sends an identification signal to the control module 200. The control module 200 determines whether the atomizer matches the battery pole basing on whether the identification signal is received in another preset time or whether the identification signal is correct. When the control module 200 determines that the atomizer doesn't match the battery pole, the control module 200 drives the warning module 700 to send out a warning.

Wherein, the control module 200 includes a microprocessor unit 210, a switch unit 220, and an identification signal identifying unit 230. The microprocessor unit 210 is connected to the battery 100, the switch unit 220, and the identification signal identifying unit 230 respectively; and the switch unit 220 is further connected to the first interface 300.

The identification signal identifying unit 230 is configured for receiving and identifying the identification signal sent from the identification signal generation module 600 by wireless transmission. The microprocessor unit 210 is configured for controlling the switch unit 220 to be turned on and off according to an identifying result generated by the identification signal identifying unit 230, and thereby controlling the battery 100 to be electrically connected with or to be electrically isolated from the first interface 300.

The present embodiment adopts wireless transmission, and the wireless transmission can be optical transmission and radio frequency transmission, etc. When the wireless transmission is the radio frequency transmission, the corresponding identification signal is an electromagnetic wave. In this embodiment, advantageously, the wireless transmission is the optical transmission. Correspondingly, the identification signal is an optical signal. When adopting the optical transmission, a mechanical connection between the battery pole and the atomizer doesn't need to be improved. Moreover, the optical transmission is suitable for atomizers without any internal integrated chip, and electronic cigarettes sending out the identification signals by the optical transmission have simple structural designs.

The identification signal generation module 600 can be any light-emitting element, such as an LED. The identification signal identifying unit 230 can be a photosensitive element, such as a photosensitive resistor, a photosensitive diode, and a phototransistor, etc. In the present application, advantageously, the identification signal identifying unit 230 is a phototransistor.

Particularly, as shown in FIGS. 2 and 3, the first interface 300 includes an anode and a cathode. The anode of the first interface 300 is a first terminal 1 of a joint connecting member, and the cathode of the first interface 300 is a second terminal 2 of the joint connecting member. Similarly, the second interface 400 includes an anode and a cathode. The anode of the second interface 400 is a third terminal 1' of the joint connecting member, and the cathode of the second interface 400 is a fourth terminal 2' of the joint connecting member. The first terminal 1 of the joint connecting member is connected to an anode of the battery, and the second terminal 2 of the joint connecting member is connected to a cathode of the battery via the switch unit 220. Thus, if the switch unit 220 is turned off, the electrical connection of the cathode of the first interface 300 is cut off. In this way, the electrical connection between the second interface 400 and the battery 100 is cut off. In this situation, even if the battery pole is connected to the atomizer mechanically, the battery pole cannot supply electric power to the atomizer. The transmission of the optical signal is achieved via a central through-hole of a joint between the battery pole and the atomizer.

The microprocessor unit 210 includes a first microprocessor U1. In this embodiment, the type of the first microprocessor U1 is SN8P2711. A first pin of the first microprocessor U1 is connected to the anode of the battery 100 via a voltage stabilizing diode D3. The aforementioned preset times can be set by the first microprocessor U1 or a timer. In this embodiment, advantageously, the preset times are set by the first microprocessor U1 directly.

The identification signal generation module 600 includes a first LED D1 and a resistor R3. The identification signal identifying unit 230 includes a phototransistor Q2 and a resistor R2. The switch unit 220 includes an MOSFET Q1 and a resistor R1, and the MOSFET Q1 is an N-type MOSFET.

In this embodiment, the detecting signal is a control signal configured for enabling the first LED D1 to work, that is, a control signal having a preset high electric level and configured for controlling the MOSFET Q1 to be turned on.

An anode of the first LED D1 is connected to the anode of the second interface 400 via the resistor R3, and a cathode of the LED D1 is connected to the cathode of the second interface 400.

An emitter of the phototransistor Q2 is connected to the cathode of the first interface 300 and a drain of the MOSFET Q1 respectively. A collector of the phototransistor Q2 is connected to the anode of the first interface 300 via the resistor R2, and the collector of the phototransistor Q2 is further connected to a seventh pin of the first microprocessor U1 via the resistor R2.

A grid of the MOSFET Q1 is connected to a fourth pin of the first microprocessor U1; a source of the MOSFET Q1 is connected to a cathode of the battery 100, and is also grounded; a drain of the MOSFET Q1 are connected to the cathode of the first interface 300. The fourth pin of the first microprocessor U1 outputs a control signal. The grid of the MOSFET Q1 is configured for receiving the control signal, and then controlling whether the cathode of the first interface 300 is grounded according to the control signal.

Wherein, the warning module 700 includes a second LED D2 and a resistor R4. An anode of the second LED D2 is connected to the anode of the battery 100, and a cathode of the second LED D2 is connected to a fifth pin of the first microprocessor U1 via the resistor R4.

When the battery pole is electrically connected to the atomizer, the first microprocessor U1 sends out a detecting signal, that is, the fourth pin of the microprocessor U1 sends out a control signal with a preset high electric level. The MOSFET Q1 is turned on by the control signal, and the first LED D1 sends out an optical signal. A base of the phototransistor Q2 is configured for sensing the optical signal sent from the first LED D1, and a collector of the phototransistor Q2 sends a current signal corresponding to the optical signal to the seventh pin of the first microprocessor U1. If the first microprocessor U1 finds that the current signal received by the seventh pin thereof is strong enough, the first microprocessor U1 determines that the atomizer is fit for the battery pole. Thus, the fourth pin of the first microprocessor U1 keeps sending out the control signal with the preset high level, the MOSFET Q1 keeps being switched on, and the battery 100 supplies electric power to the atomizing module 500. Meanwhile, the fifth pin of the first microprocessor U1 outputs an electrical signal with another high electric level, and the second LED D2 is turned off. If the first microprocessor U1 finds that the current signal received by the seventh pin thereof is not strong enough, the first microprocessor U1 determines that the atomizer is not fit for the battery pole. Thus, the fourth pin of the first microprocessor U1 outputs a control signal with a preset low electric level, the MOSFET Q1 is turned off, and the battery 100 stops supplying electric power to the atomizing module 500. Meanwhile, the fifth pin of the first microprocessor U1 outputs an electrical signal with another low electric level, and the second LED D2 is turned on and emits a warning light.

It can be understood that in another embodiment, the identification signal generation module 600, a button battery configured for supplying electric power to the identification signal generation module 600, and a signal emitting switch configured for controlling the identification signal generation module 600 to emit the optical signal are all disposed in the atomizer. The control module 200 configured for identifying the optical signal and controlling the battery 100 to be electrically connected with or to be electrically isolated from the atomizing module 500 is disposed in the battery pole. In this embodiment, when the battery pole is connected to the atomizer mechanically and the signal emitting switch is turned on, the identification signal generation module 600 sends the optical signal to the battery pole for identification. Thus, the effect that the atomizer is identified by the battery pole, as detailed in the first embodiment, is achieved.

Figure 4:
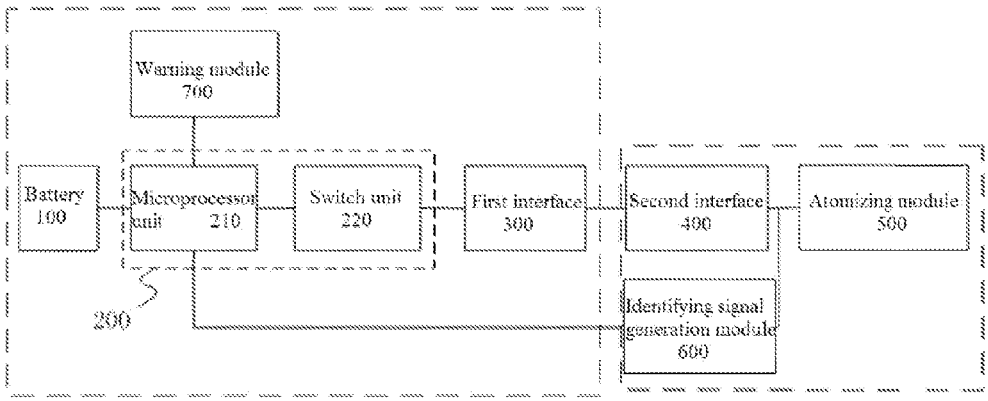
FIG. 4 is a block diagram of an electronic cigarette of a second embodiment of the present application.
Figure 5:
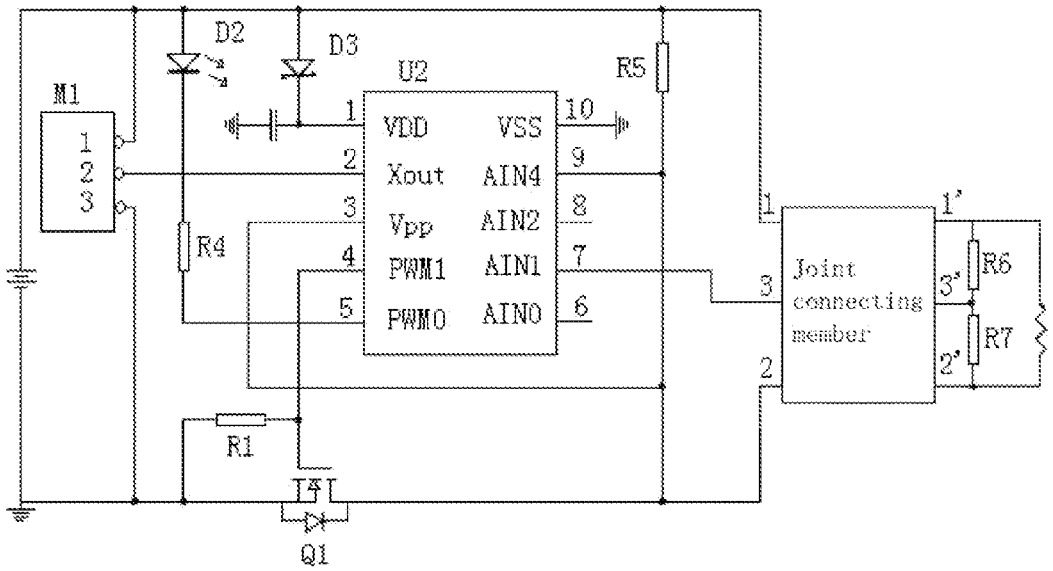
FIG. 5 is a circuit diagram of the electronic cigarette shown in FIG. 4.

FIG. 4 is a block diagram of an electronic cigarette of a second embodiment of the present application; and FIG. 5 is a circuit diagram of the electronic cigarette shown in FIG. 4.

In the second embodiment, only after the identification signal generation module 600 receives a detecting signal from the control module 200, the identification signal generation module 600 sends out an identification signal. The identification signal is sent to the control module 200 by wired transmission.

The control module 200 includes a microprocessor unit 210 and a switch unit 220.

The microprocessor unit 210 is connected to the battery 100, the switch unit 220, and the identification signal generation module 600 respectively; and the switch unit 220 is further connected to the first interface 300.

The microprocessor unit 210 is configured for receiving and identifying the identification signal generated by the identification signal generation module 600 by the wired transmission. The microprocessor unit 210 is further configured for controlling the switch unit 220 to be turned on and off basing on the identifying result, and thereby controlling an electrical connection of the first interface 300 to be established or to be cut off.

In the second embodiment, the identification signal can be an electric level signal, a voltage value, or an ID information number. The electric level signal can be generated by using a pull-up resistor or a pull-down resistor. The voltage value can be generated by using a divider resistor. The ID information number can be generated by using a PWM signal. If the identification signal is the ID information number, the atomizer requires being equipped with an integrated chip. In this situation, the identification signal generation module 600 is the integrated chip. Advantageously, in the second embodiment, the identification signal is the electric level signal.

Particularly, as shown in FIGS. 4 and 5, the microprocessor unit 210 includes a second microprocessor U2, and the type of the second microprocessor U2 is SN8P2711. The operation for setting up the preset time is the same as that detailed in the first embodiment.

It should be noticed that, in the second embodiment, the atomizer is connected to the battery pole via three electrodes, while the atomizer is connected to the battery pole via two electrodes in the first embodiment. The added electrode is configured for achieving wired data transmission for the identification signal. Particularly, a pair of terminals, which are a fifth terminal 3 and a sixth terminal 3', are added into the joint connecting member.

The identification signal generation module 600 includes a pull-down resistor R7 and a resistor R6. Wherein, the resistance of the pull-down resistor R7 is much less than the resistance of the resistor R6. One end of the resistor R6 is connected to the anode of the second interface 400 (i.e., the third terminal 1'), and the other end of the resistor R6 is connected to one end of the pull-down resistor R7. The other end of the pull-down resistor R7 is connected to the cathode of the second interface 400 (i.e., the fourth terminal 2'). The sixth terminal 3' is connected between the resistor R6 and the pull-down resistor R7, and the fifth terminal 3 is connected to the seventh pin of the second microprocessor U2. The wired connection between the identification signal generation module 600 and the control module 200 is established via the sixth terminal 3' and the fifth terminal 3.

When the battery pole is electrically connected to the atomizer, the second microprocessor U2 sends out a detecting signal (i.e., the fourth pin of the second microprocessor U2 outputs a control signal with a preset high electric level), and the MOSFET Q1 is switched on. The resistor R6 cooperates with the pull-down resistor R7 to form a bleeder circuit. Because of the pull-down action of the pull-down resistor R7, the seventh pin of the second microprocessor U2 receives a preset low electric level, and thus the second microprocessor U2 determines that the atomizer is fit for the battery pole and controls the fourth pin of the second microprocessor U2 to send a control signal with a preset high electric level to the MOSFET Q1. The MOSFET Q1 is switched on, and the battery 100 supplies electric power to the atomizing module 500. Meanwhile, the fifth pin of the second microprocessor U2 sends out an electrical signal with another preset high electric level, and the second LED D2 is turned off. Otherwise, if the seventh pin of the second microprocessor U2 detects a high electric level, the second microprocessor U2 determines that the atomizer is not fit for the battery pole, and controls the fourth pin of the second microprocessor U2 to send another control signal with a preset low electric level to the MOSFET Q1. The MOSFET Q1 is turned off, and the battery 100 stops supplying electric power to the atomizing module 500. Meanwhile, the fifth pin of the second microprocessor U2 outputs an electrical signal with another low electric level, and the second LED D2 is switched on and emits a warning light.

In the two aforementioned embodiments, the atomizer is identified after the atomizer is electrically connected to the battery pole. Furthermore, the atomizer can also be identified after each smoking action applied to the electronic cigarette. In this situation, the battery pole further includes a smoking trigger unit. The smoking trigger unit is connected to the control module 200, and the smoking trigger unit is configured for sending a smoking trigger signal to the control module 200 upon sensing air flow. When receiving the smoking trigger signal, the control module 200 determines whether the atomizer matches with the battery pole according to the identification signal. As shown in FIGS. 3 and 5, an air flow sensor M1 is connected to a second pin of the first microprocessor U1 or the second microprocessor U2. When the air flow sensor M1 senses air flow, the air flow sensor M1 generates a corresponding current signal and sends the current signal to the first microprocessor U1 or the second microprocessor U2. Upon receiving the current signal, the first microprocessor U1 or the second microprocessor U2 sends out a detecting signal to identify the atomizer. Advantageously, the atomizer can be identified after the number of the smoking actions applied to the electronic cigarette reaches a preset value, which can be achieved by an internal counter of the first microprocessor U1 or the second microprocessor U2.

Figure 6:
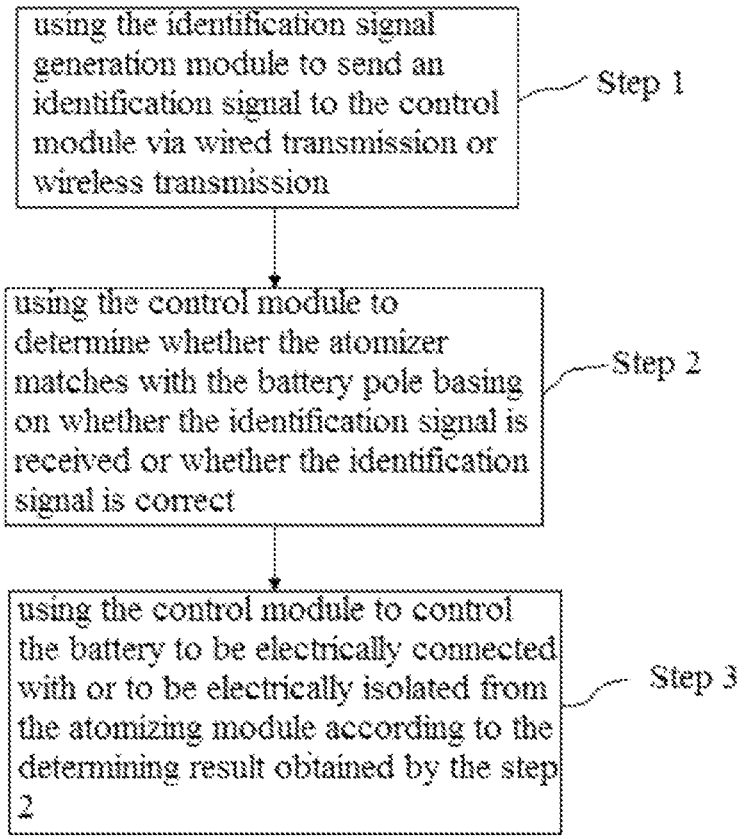
FIG. 6 is a flow chart of a method for identifying an atomizer, in accordance with the present application.

According to the electronic cigarette which can identify the atomizer, the present application further provides a method used in an electronic cigarette for identifying an atomizer. FIG. 6 is a flow chart of the method for identifying an atomizer, in accordance with an embodiment of the present application.

The atomizer identifying method comprises these steps:

Step 1: the identification signal generation module 600 sends an identification signal to the control module 200 via wired or wireless transmission. The identification signal generation module 600 can send out the identification signal actively or passively. Wherein, sending out the identification signal passively means that the identification signal generation module 600 sends the identification signal to the control module 200 only after the control module 200 sends the detecting signal to the identification signal generation module 600.

Wherein, the wireless transmission includes optical transmission and radio frequency transmission, etc. When the wireless transmission is the optical transmission, the corresponding identification signal is an optical signal; and when the wireless transmission is the radio frequency transmission, the corresponding identification signal is an electromagnetic wave.

The identification signal sent via the wired transmission can be an electric level signal, a voltage value, or an ID information number.

Step 2: the control module 200 determines whether the atomizer matches with the battery pole basing on whether the identification signal is received or whether the identification signal is correct.

Step 3: the control module 200 controls the battery 100 to be electrically connected with or to be electrically isolated from the atomizing module 500 according to the determining result obtained by the step 2. The step 3 can further includes: using the control module 200 to control the warning module 700 to send out a warning according to the determining result obtained by the step 2.

Figure 7:
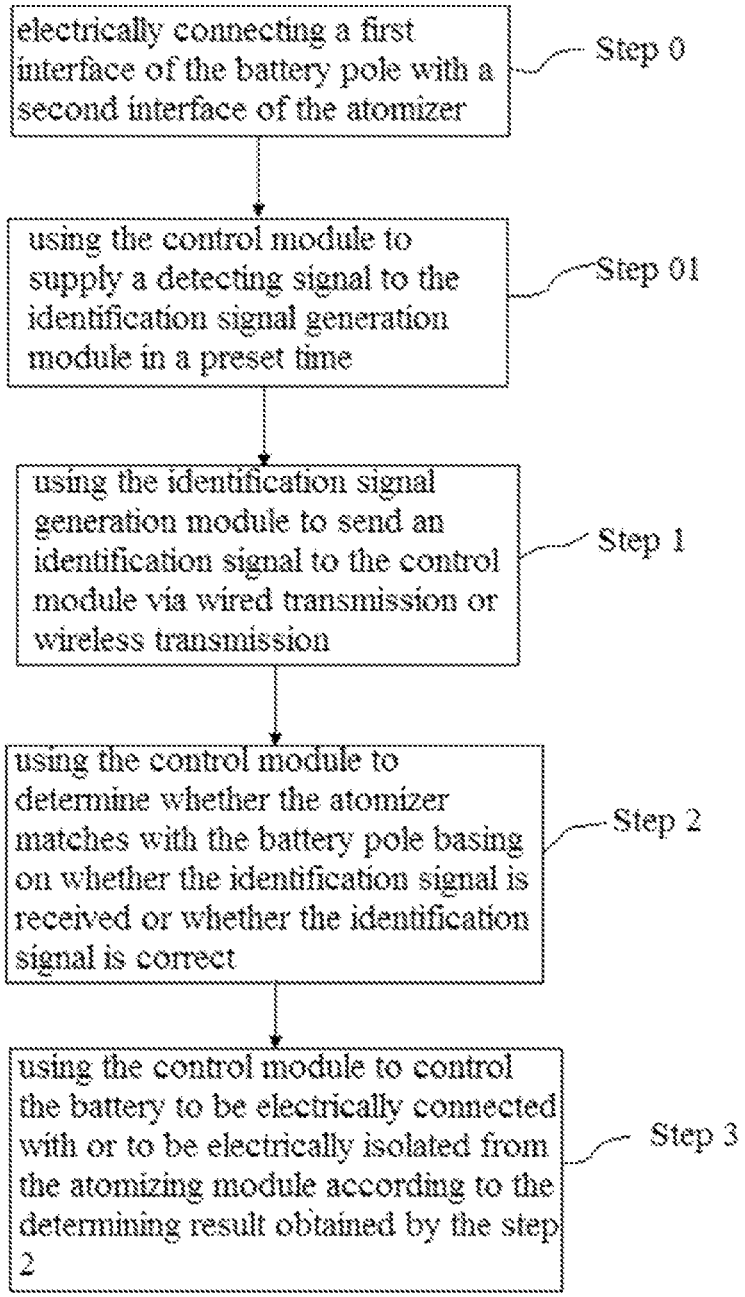
FIG. 7 is a flow chart of a method for identifying an atomizer, in accordance with a first embodiment of the present application.

FIG. 7 is a flow chart of a method for identifying an atomizer, in accordance with a first embodiment of the present application.

In the first embodiment, the control module 200 needs to send out a detecting signal. Particularly, compared with the method shown in FIG. 6 and detailed above, the method in accordance with the first embodiment of the present application further comprises:

Step 0: before the step 1, electrically connecting a first interface 300 of the battery pole with a second interface 400 of the atomizer.

Step 01: between the step 0 and the step 1, using the control module 200 to send a detecting signal to the identification signal generation module 600 in a preset time.

Figure 8:
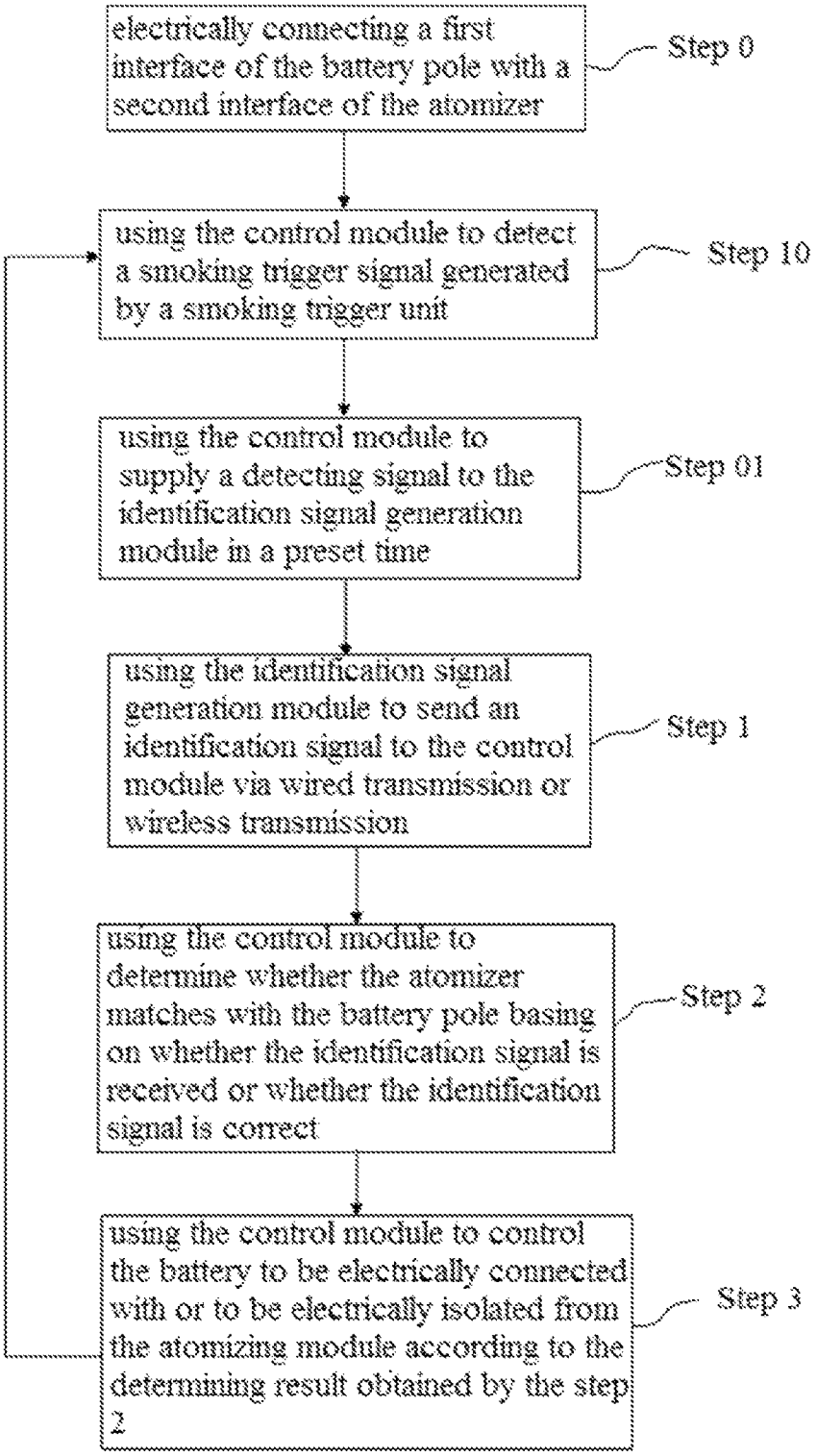
FIG. 8 is a flow chart of a method for identifying an atomizer, in accordance with a second embodiment of the present application.

FIG. 8 is a flow chart of a method for identifying an atomizer, in accordance with a second embodiment of the present application.

The difference between the method of the second embodiment and the method of the first embodiment is that: in the method of the first embodiment, the atomizer is immediately identified as soon as the atomizer is electrically connected to the battery pole, and the atomizer is identified only once; while in the method of the second embodiment, the atomizer is identified only when the electronic cigarette is smoked, and the atomizer is identified after every smoking action applied to the electronic cigarette.

Particularly, compared with the method of the first embodiment, the method of the second embodiment further comprises:

Step 10: between the step 0 and the step 01, using the control module 200 to detect a smoking trigger signal generated by a smoking trigger unit.

Besides, after the step 3 is completed, the step 10 is performed again to wait a next identification.

The smoking trigger signal generated by the smoking trigger unit is a current signal generated by an air flow sensor. When sensing air flow, the air flow sensor generates the current signal. When the electronic cigarette is smoked once, the smoking trigger signal is generated by the air flow sensor correspondingly, and is sent to the microprocessor unit 210 of the control module 200. When the microprocessor unit 210 receives the smoking trigger signal, the step 01 is started, and the atomizer is identified. In the second embodiment, after the atomizer is identified in the step 3, the step 10 is performed again to wait a next identification for the atomizer triggered by a next smoking action.

Figure 9:
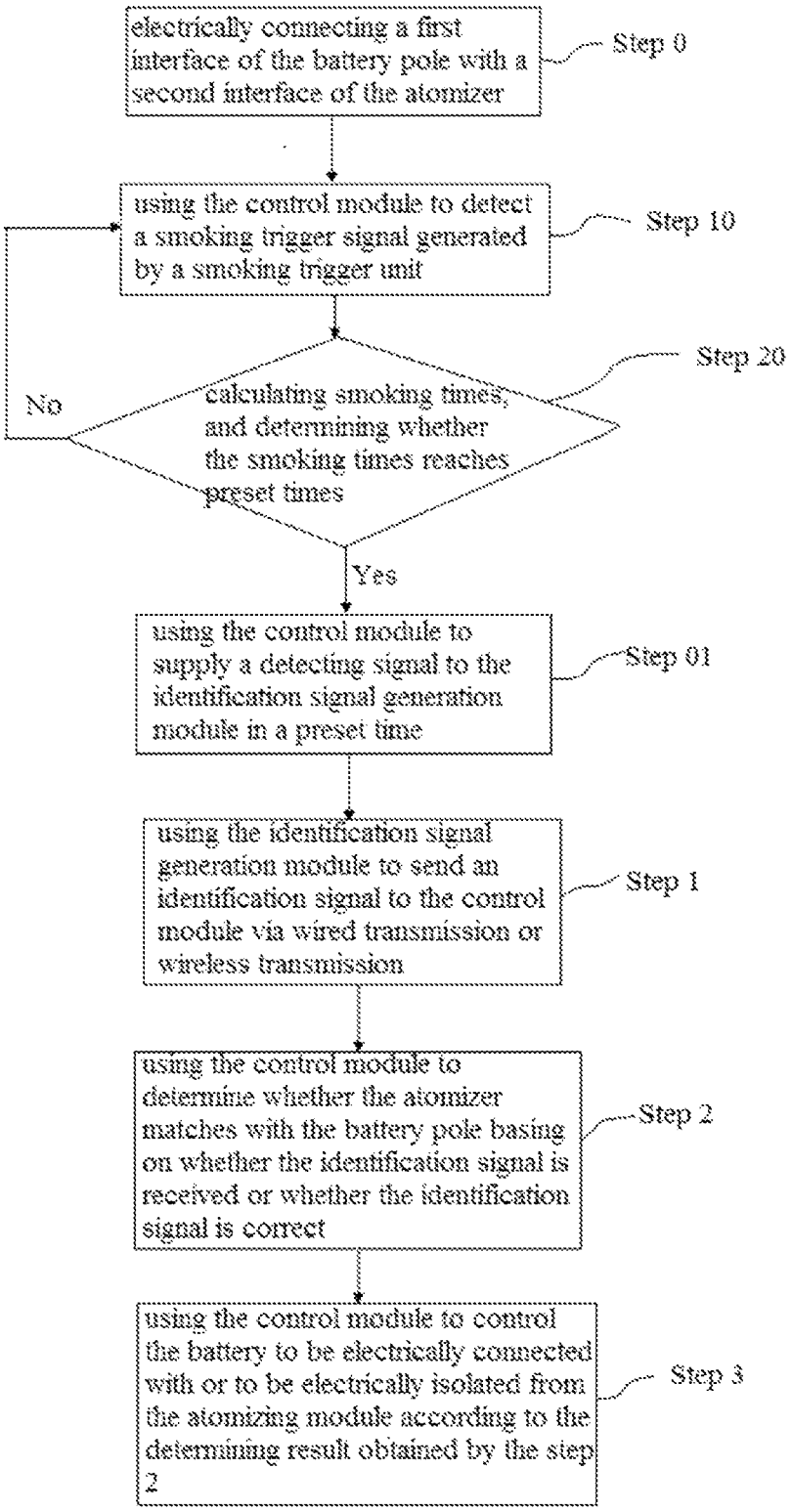
FIG. 9 is a flow chart of a method for identifying an atomizer, in accordance with a third embodiment of the present application.

FIG. 9 is a flow chart of a method for identifying an atomizer, in accordance with a third embodiment of the present application.

The difference between the method of the third embodiment and the method of the second embodiment is that: in the method of the second embodiment the atomizer is identified after every smoking action applied to the electronic cigarette; while in the method of the third embodiment, the atomizer is identified when the number of the smoking actions applied to the electronic cigarette reaches a preset value. Besides, in the method of the third embodiment, the atomizer is not identified again after one identification action for the atomizer is completed.

Particularly, compared with the method of the first embodiment, the method of the third embodiment further comprises:

Step 10: between the step 0 and the step 01, using the control module 200 to detect a smoking trigger signal generated by a smoking trigger unit.

Step 20: between the step 10 and the step 01, calculating the number of the smoking actions applied to the electronic cigarette, and determining whether the number of the smoking actions reaches a preset value; if the number of the smoking actions doesn't reach the preset value, the step 10 is performed again; otherwise, if the number of the smoking actions reaches the preset value, the step 01 is performed.

In the third embodiment, when the number of the smoking actions doesn't reach the preset value, whether the atomizer is fit for the battery pole is not considered. When the electronic cigarette is shown, the electronic cigarette is convenient to experience for users.

Above all, the electronic cigarette of present application adds the identification signal generation module into the atomizer, and the identification signal generation module is configured to send the identification signal to the control module of the battery pole by wired transmission or wireless transmission. The control module determines whether the atomizer matches the battery pole basing on whether the identification signal is received or whether the identification signal is correct, and then controls the battery to be electrically connected with or to be electrically isolated from the atomizing module according to the determining result. Thus, the atomizer can be identified by the electronic cigarette of the present application. Only if the atomizer is identified as matching the battery pole, the battery pole supplies electric power to the atomizer. If the atomizer does not match the battery pole, although the battery pole is mechanically connected with the atomizer, the control module in the battery pole controls the power supply circuit between the battery and the atomizing module to be cut off. Thus, the case that the smoke generated by the atomizer may have a peculiar smell or the amount of the smoke may be very small due to the difference between the rated power of the atomizer and the rated power of the battery pole, and the case that the atomizer may start over-current protection and do not generate any smoke due to the difference between the resistance of the heating wire of the atomizer and the resistance of the battery pole, can be avoided. Besides, when the battery pole is identified as not matching the atomizer, the present application can control the warning module to send out a warning and thereby remind users to find the problem in time.

Furthermore, the method for identifying the atomizer of the present application not only provides a simple method for one-time identifying the atomizer when the atomizer is electrically connected to the battery pole, but also provides a method for identifying the atomizer after every smoking action applied to the electronic cigarette. Thus, possible identification misses caused by replacing the battery pole can be avoided, and the identification is ensured to be rigorous and reliable. In addition, the present application further provides a method for identifying the atomizer when the number of the smoking actions applied to the electronic cigarette reaches a preset value, which gives experience to users and is very convenient when the electronic cigarette is shown.

While the embodiments of the present application are described with reference to the accompanying drawings above, the present application is not limited to the above-mentioned specific implementations. In fact, the above-mentioned specific implementations are intended to be exemplary not to be limiting. In the inspiration of the present application, those ordinary skills in the art can also make many modifications without breaking away from the subject of the present application and the protection scope of the claims. For example, the control module 200 can be disposed in the atomizer, the identification signal generation module 600 can be disposed in the battery pole, and the atomizer and the battery pole can be identified before the atomizer is connected to the battery pole mechanically. In addition, the identification signal generation module 600 can be disposed in a lamp cap of the battery pole, and the optical signal can be generated by a lamp mounted in the lamp cap and imitating the burning of tobacco. All these modifications belong to the protection of the present application.

What is claimed is:

1. An electronic cigarette comprising a battery pole and an atomizer, wherein the battery pole includes a battery and a control module electrically connected to the battery, and the atomizer includes an identification signal generation module and an atomizing module;

wherein the control module includes a microprocessor unit, a switch unit, and an identification signal identifying unit;

wherein the microprocessor unit is connected to the battery, the switch unit, and the identification signal identifying unit respectively;

wherein the microprocessor unit is configured for sending a detecting signal to the identification signal generation module in a preset time;

wherein the identification signal generation module is configured for sending an identification signal when receiving the detecting signal; the identification signal identifying unit is configured for receiving the identification signal from the identification signal generation module by wireless transmission and identifying the identification signal;

wherein the microprocessor unit is further configured for controlling the switch unit to be turned on and off according to an identifying result generated by the identification signal identifying unit, and then controlling the battery to be electrically connected with or to be electrically isolated from the atomizing module;

wherein the microprocessor unit includes a first microprocessor, a type of the first microprocessor U1 is SN8P2711, wherein the identification signal generation module includes a first LED, and the identification signal identifying unit includes a phototransistor;

wherein a base of the phototransistor is configured for sensing an optical signal sent from the first LED, and then driving a collector of the phototransistor to send a current signal corresponding to the optical signal to the microprocessor unit;

wherein the battery pole further includes a first interface, and the atomizer further includes a second interface; the switch unit is further connected to the first interface;

wherein an anode of the first LED is connected to an anode of the second interface, and a cathode of the first LED is connected to a cathode of the second interface; an emitter of the phototransistor is connected to a cathode of the first interface, and the collector of the phototransistor is connected to an anode of the first interface and the microprocessor unit respectively;

wherein the anode of the first interface is a first terminal of a joint connecting member, and the cathode of the first interface is a second terminal of the joint connecting member; the anode of the second interface is a third terminal of the joint connecting member, and the cathode of the second interface is a fourth terminal of the joint connecting member; the first terminal of the joint connecting member is connected to an anode of the battery, and the second terminal of the joint connecting member is connected to a cathode of the battery, when the switch unit is turned off, an electrical connection between the second interface and the battery is cut off even if the battery pole is connected to the atomizer mechanically;

wherein the identification signal is the optical signal and a transmission of the optical signal is achieved via a central through-hole of a joint between the battery pole and the atomizer;

wherein, the switch unit includes an MOSFET; a grid of the MOSFET is connected to the microprocessor unit, a source of the MOSFET is grounded, and a drain of the MOSFET is connected to the cathode of the first interface; and the grid of the MOSFET is configured for receiving a control signal sent from the microprocessor unit and controlling the MOSFET to be turned on and off according to the control signal;

wherein the battery pole further includes a warning module, and the warning module is connected to the control module;

wherein the warning module includes a second LED and a resistor, an anode of the second LED is connected to the anode of the battery;

wherein a first pin of the first microprocessor is connected to the anode of the battery via a voltage stabilizing diode, a fourth pin of the first microprocessor is connected to a grid of the MOSFET, a fifth pin of the first microprocessor is connected to a cathode of the second LED via the resistor, a seventh pin of the first microprocessor is connected to the collector of the phototransistor; when the battery pole is electrically connected to the atomizer, the fourth pin of the first microprocessor is configured for sending out a control signal to control the MOSFET to be turned on or turned off, the seventh pin of the first microprocessor is configured for receiving a current signal to determine whether the atomizer is fit for the battery pole, the fifth pin of the first microprocessor is configured for outputting an electrical signal to turn on the second LED to emit a warning light; the first microprocessor is further configured for setting the preset time directly; and wherein the warning module is configured for sending a warning under the control of the control module when the control module determines that the atomizer doesn't match with the battery pole.

2. The electronic cigarette according to claim 1, wherein the first interface is connected to the battery and the control module respectively, and the second interface is connected to the first interface, the atomizing module, and the identification signal generation module respectively;

the first interface and the second interface are configured for connecting with each other to achieve an electrical connection between the battery and the atomizing module.

3. The electronic cigarette according to claim 1, wherein the battery pole further includes a smoking trigger unit, and the smoking trigger unit is connected to the control module; the smoking trigger unit is configured for sending a smoking trigger signal to the control module when sensing air flow;

the control module is configured for determining whether the atomizer matches with the battery pole according to the identification signal after receiving the smoking trigger signal.

* * * * *